US005345493A

United States Patent [19]

D'Achard Van Enschut et al.

[11] Patent Number: 5,345,493

[45] Date of Patent: Sep. 6, 1994

[54] X-RAY TUBE WITH A REDUCED WORKING DISTANCE

[75] Inventors: Johannes D'Achard Van Enschut; Lourens Valkonet, both of Eindhoven, Netherlands

[73] Assignee: U.S. Philips Corporation, New York, N.Y.

[21] Appl. No.: 8,114

[22] Filed: Jan. 25, 1993

[30] Foreign Application Priority Data

Jan. 27, 1992 [EP] European Pat. Off. ..... 92200205.0

[51] Int. Cl.[5] ..... H01J 35/30

[52] U.S. Cl. ..... 378/137; 378/136; 378/138

[58] Field of Search ..... 378/136, 137, 138, 121, 378/134, 140, 141

[56] References Cited

U.S. PATENT DOCUMENTS 2,482,275 9/1949 Horsley ..... 378/137 X
2,679,017 5/1954 Rogers et al. ..... 378/138 X
3,668,454 6/1972 Shimura ..... 378/136
4,229,657 10/1988 Bensussan et al. ..... 378/137 X
4,969,173 11/1990 Valkonet ..... 378/136

FOREIGN PATENT DOCUMENTS 0439852 12/1990 European Pat. Off. .
2749856 5/1979 Fed. Rep. of Germany ..... 378/136

*Primary Examiner*—David P. Porta
*Attorney, Agent, or Firm*—Anne E. Barschall

[57] ABSTRACT

In an X-ray tube for an X-ray analysis apparatus an optimized minimum working distance is achieved, together with an adequately high radiation yield, by integrated optimization of the radiation end of the tube, the position and the mounting of the exit window, and the electron-optical configuration in the tube. This results in an X-ray tube having a conical end, an angle of cone of approximately 45° and the use of the cone as such in the electron-optical system of the tube. Exact determination of the anode position relative to a reference face outside the tube enables exact positioning of each individual tube in an analysis apparatus.

9 Claims, 1 Drawing Sheet

X-RAY TUBE WITH A REDUCED WORKING DISTANCE

The invention relates to an X-ray tube, comprising a cathode, an anode and an electron-optical system which is accommodated in a cylindrical envelope which comprises a radiation exit window situated at one axial end, and also relates to an X-ray analysis apparatus comprising such an X-ray tube.

An X-ray tube of this kind is known from EP 439 852. An X-ray tube described therein comprises a conical axial end which supports a window, a cathode which is mounted adjacent an anode pipe, and an electron-optical system which includes a deflection electrode, mounted between the cathode and the anode, an aperture in a cathode housing, and the anode itself.

Using the electron-optical system, an electron beam to be emitted by the cathode is directed onto the anode surface so that the electrons for generating X-rays are incident at an angle of at least approximately 45° thereon. Such an X-ray tube satisfies the demand for an X-ray source having a comparatively high radiation power in order to realise a comparatively short working distance for irradiation of an object or specimen in an X-ray analysis apparatus. For various applications, the working distance associated with the output power is still found to be excessive, so that the relevant measurements cannot be optimally performed.

It is an object of the invention to comply with said demand to an even greater extent; to achieve this, an X-ray tube of the kind set forth in accordance with the invention is characterized in that the electron-optical system, the anode window geometry and the window construction and the window-supporting end of the tube are integrally conceived to minimize a radiation distance between the anode surface and a surface of an object to be irradiated in an X-ray analysis apparatus.

Because relevant parts of an X-ray tube in accordance with the invention are integrally conceived to minimize the anode-object distance in an analysis apparatus, a substantial gain is thus achieved.

More specifically, the exit window is supported on an axial sealing plate having a uniform, minimum material thickness. Because the window plate, customarily made of beryllium, is mounted on an end sealing plate without special mounting rims or recesses, the entire sealing plate may have a uniform thickness, said thickness being chosen to achieve adequate vacuum-tightness of the tube, for example an iron-nickel or copper-nickel plate having a thickness of only approximately 1 mm. Notably because of its coefficient of expansion, copper-nickel is particularly suitable for use in conjunction with a beryllium window.

In a preferred embodiment, the conical shape has an optimized angle of substantially exactly 45° and a conical part thereof forms part of the electron-optical system. Because the conical tube wall portion itself forms part of the electron-optical system, a substantial reduction of the transverse dimension of the tube can be achieved in comparison with the arrangement of the deflection electrode between the anode pipe and the cone, thus offering a substantial gain when mounted in an analysis apparatus. Notably a cooling duct (23) is arranged around the tube so that no part thereof projects substantially from the cone. By making a different choice in respect of various dimensions, the cone angle may be chosen to be slightly smaller than 45° and the space thus saved at the outer edge of the cone can be utilized to bound a cooling duct.

In a further embodiment, an X-ray tube is provided with an external abutment face for mounting in an analysis apparatus, the distance between said abutment face and the anode abutment face being exactly defined.

In a preferred embodiment, the electron emitter of the cathode is an annular emitter which is accommodated in a cathode housing and which is mounted around the anode pipe.

Some preferred embodiments in accordance with the invention will be described in detail hereinafter with reference to the drawing. Therein:

Figure 1:
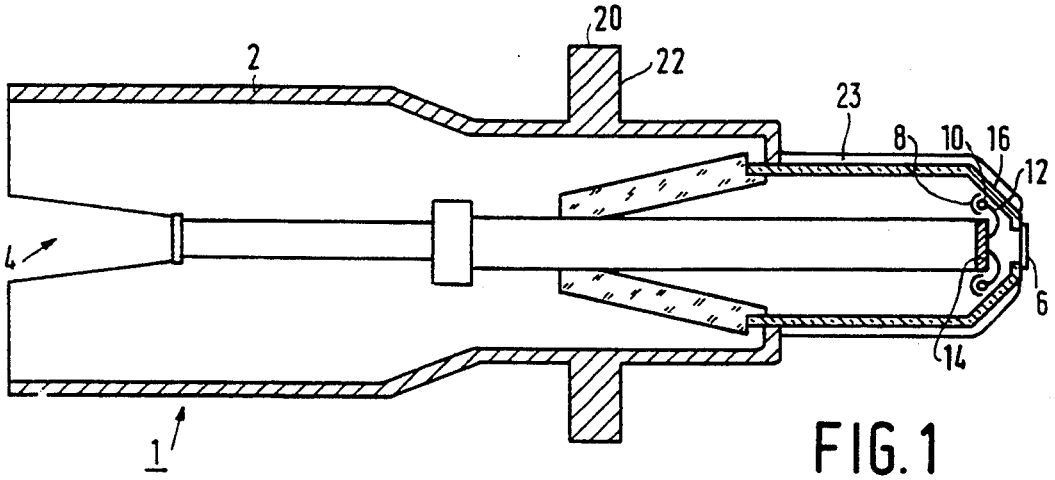
FIG. 1 shows an X-ray tube in accordance with the invention.

An X-ray tube 1 as shown in FIG. 1 comprises, arranged within an envelope 2 with a connector socket 4 and a window 6, an electron emitter 10 which is accommodated in a cathode sleeve 8 and which consists of, for example a filament. Electrons (12) emitted by the emitter are directed onto an anode 14. The electron paths are determined by the geometry of the cathode sleeve, the cathode, the anode and in this case also by the shape of a conical portion 16 of the tube envelope. The geometry of the cone 16 of the tube is chosen so as to achieve a minimum working distance between the anode 14 and an object to be irradiated. The other electron-optical elements are also chosen so that operation is possible with a minimum distance between the, anode 14 and the window 6; this is why the cone 16 as such acts as an electron-optical electrode and the use of an additional electrode in the cathode-anode space of the tube is dispensed with. The window 6 is mounted on the cone so as to have a minimum structural length. This is achieved, for example by mounting the window directly on the edge of minimum thickness instead of providing a recess in a window edge of the cone to support the window; mounting on the inner side or on the outer side of the tube is also possible. The working distance is thus realised by the internal geometry of the sleeve, by the external geometry of a radiation end thereof, as well as by integrated cooperation of these two factors. Because of the small working distance, for suitable radiation reproducibility it is desirable that the distance between the anode and the specimen surface is exactly defined and known. To this end, the position of the anode in the tube is determined relative to a flange 20 outside the tube. An abutment face 22 then serves as a reference face for mounting the tube in an X-ray analysis apparatus.

Figure 2:
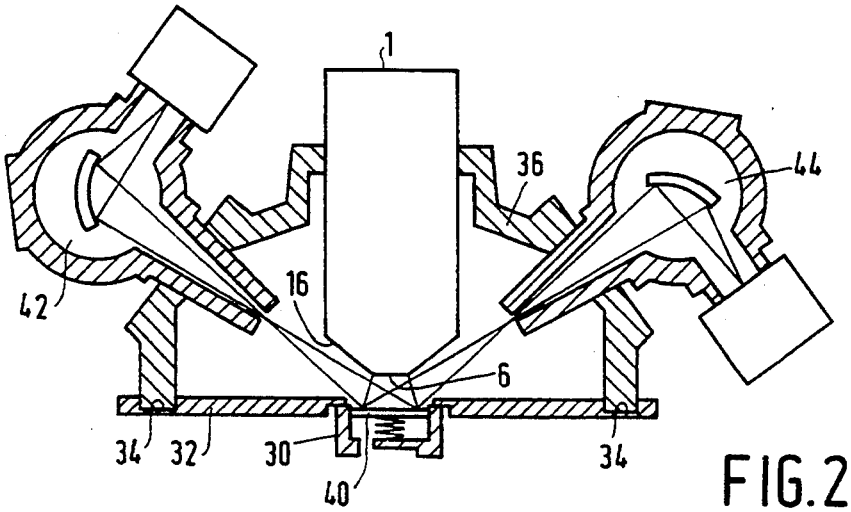
FIG. 2 shows relevant parts of a simultaneous spectrometer in which an X-ray tube is mounted as a radiation source.

FIG. 2 shows the X-ray tube 1 mounted in a simultaneous spectrometer, comprising a specimen table 30, a mounting plate 32, surface portions 34 of which can act, for example as reference faces, a housing 36 for a number of measuring channels, two channels 42 and 44 which are symmetrically situated relative to an object or specimen 40 being indicated. From a point of view of radiation efficiency it is important to minimize the distance between the window 6 of the tube and the specimen 40. As appears from the Figure, the thickness of the tube and the shape of the cone 16 are of major importance in this respect. Optimization thereof in combination with said optimization of the tube itself, subject to the secondary condition imposed by mounting, offers a substantial gain in respect of radiation efficiency which can be translated into tube service life, speed of measurement, resolution etc.

Figure 3:
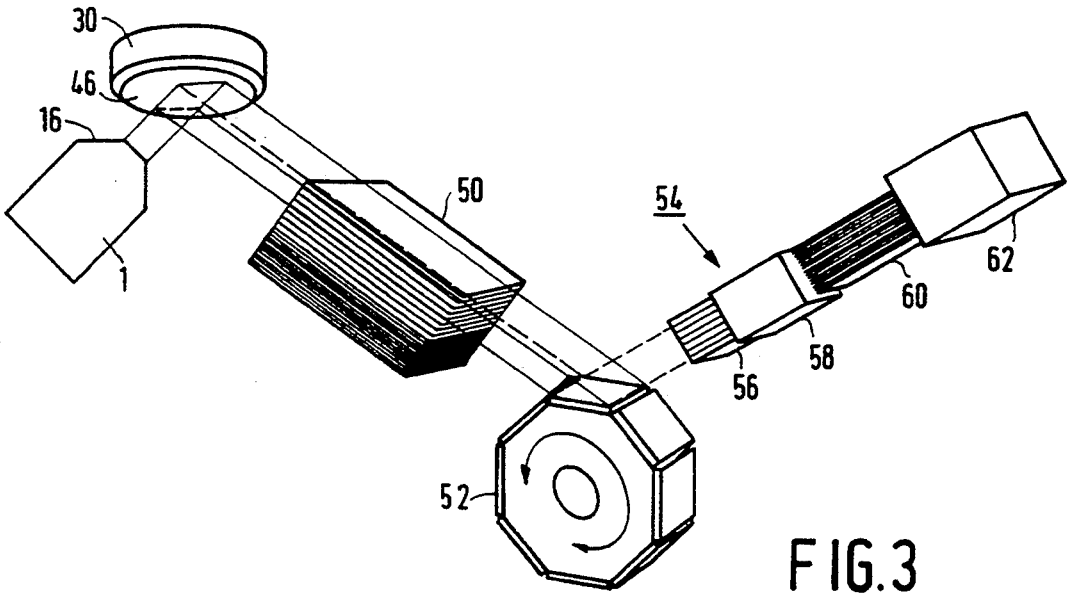
FIG. 3 shows relevant parts of a sequential spectrometer comprising an X-ray source in the form of such an X-ray tube.

FIG. 3 shows the mounting of the X-ray tube in a sequential spectrometer in which the feasible mounting distance between the tube 1 and the specimen 40 is limited by the space for an entrance collimator 50, preferably consisting of several portions which can be exchanged in respect of position and, therefore, occupying a comparatively large amount of space, whereto the geometry of the tube must be adapted again. Optimization of the working distance again imposes a preferred shape for the cone 16, leading to a similar shape due to the geometry which is comparable with the position in the simultaneous spectrometer. The sequential spectrometer also comprises a crystal turret 52 and a detector system 54 which is in this case provided, by way of example, with a first detection collimator 56, a gas ionization detector 58, a second detection collimator 60 and a scintillation detector 62. Both positions result in a conical shape with an angle of cone of approximately 45°. For reasons of geometry or electron-optical reasons, a different angle may be used should that be desirable because of other parameters.

We claim:

1. An x-ray tube comprising a) an annular cathode (10) concentric with an axis of the tube and defining a cathode diameter;

b) an anode (14) for emitting x-rays, the anode being concentric with said annular cathode and contained within a diameter about said axis which diameter is smaller than the cathode diameter; and c) an envelope including:

i) an exit window (6), concentric with said axis, for receiving x-radiation emitted by said anode; and ii) a conical member (16), concentric with said axis, said conical member having a wide end and a narrow end, the wide end having a diameter larger than the cathode diameter, the narrow end supporting said exit window, said conical member acting as an electron-optical electrode which helps determine an electron path between said cathode and said anode, whereby no additional electrode is needed in a cathode-anode space of the tube and whereby a distance between a surface of the anode and a surface of an object to be irradiated is minimized.

2. An X-ray tube as claimed in claim 1, characterized in that the exit window is supported on an axial sealing plate of a minimum, uniform material thickness.

3. The x-ray tube of claim 1, further comprising an anode pipe, concentric with the anode, having an end for supporting the anode near the exit window, and wherein an extent of the conical member from the narrow end to the wide end does not go substantially beyond a plane containing the anode.

4. An x-ray tube as claimed in claim 1, characterized in that the window is made of beryllium, the narrow end functions as a sealing plate for supporting the window, the conical member is made of a material adapted to beryllium in respect of coefficient of expansion, and the tube further comprises a cooling duct, which does not project beyond the conical member, disposed around the envelope.

5. The x-ray tube of claim 4, wherein the sealing plate is copper-nickel.

6. The x-ray tube of claim 4, wherein the sealing plate is iron-nickel.

7. An X-ray analysis apparatus comprising an X-ray tube as claimed in claim 1.

8. The x-ray tube of claim 1 further comprising an abutment face (22) projecting from an exterior of the envelope, which abutment face has a known distance along the axis from the anode, whereby a distance between the anode and an x-ray target may be measured.

9. The x-ray tube of claim 1 wherein the conical member forms an angle of approximately 45° with said axis.

* * * * *